United States Patent [19]

Weiss

[11] Patent Number: 4,471,932

[45] Date of Patent: Sep. 18, 1984

[54] EAVESTROUGH CORNER BRACKET

[76] Inventor: Jacob B. Weiss, 270 Bryden Rd., Kelowna, British Columbia, Canada, V1X 3Y4

[21] Appl. No.: 373,416

[22] Filed: Apr. 30, 1982

Related U.S. Application Data

[62] Division of Ser. No. 124,317, Feb. 25, 1980, Pat. No. 4,338,808.

[51] Int. Cl.[3] ..... E04D 13/06

[52] U.S. Cl. ..... 248/48.2; 248/300; 405/120

[58] Field of Search ..... 248/48.2, 48.1, 300, 248/220.1; 405/120; 228/142; 72/379; 29/150, 157 A

[56] References Cited

U.S. PATENT DOCUMENTS 1,044,886 11/1912 Hines et al. ..... 248/48.1
3,469,811 9/1969 Crain ..... 248/300
3,841,101 10/1974 Henfrey ..... 248/48.2
4,138,081 2/1979 Nilsson ..... 248/300
4,338,808 7/1982 Weiss ..... 72/379

*Primary Examiner*—William H. Schultz
*Assistant Examiner*—Ramon O. Ramirez
*Attorney, Agent, or Firm*—Carver & Company

[57] ABSTRACT

An eavestrough corner bracket made from an elongated bendable sheet strip with a longitudinal axis. The bracket has inner and outer portions folded about the longitudinal axis to produce respective corner side portions inclined to each other to define side walls of opposed corners which are generally complementary to adjacent intersecting inner and outer portions of the eavestroughing. The bracket has an intermediate portion disposed between the inner and central portions thereof, the intermediate portion having a plurality of folds to incline corner portions of the bracket for both an outside corner and for an inside corner of the bracket.

8 Claims, 8 Drawing Figures

EAVESTROUGH CORNER BRACKET

CROSS REFERENCES TO RELATED APPLICATIONS

This is a divisional application of my application entitled EAVESTROUGH CORNER BRACKET filed on Feb. 25, 1980 under Ser. No. 06/124,317, now U.S. Pat. No. 4,338,808.

BACKGROUND OF THE INVENTION

1. Field of the Invention

The invention relates to a corner bracket for supporting and connecting adjacent portions of eavestroughing at either an outside corner or an inside corner of a roof.

2. Prior Art

Eavestroughs for collecting water shed from roofs are commonly joined at corners by mitering ends and sealing the ends with caulked straps, tape, etc. Alternatively, L-shaped corner portions or elbows with square cut ends for connecting straight portions of eavestroughing are used. Early materials used for eavestroughing included wood, steel, etc. but rolled aluminum sections are gaining in popularity. Aluminum eavestroughing is lightweight, corrosion resistant and it is commonly joined with corner portions or elbows, and separate brackets are then used to secure the corner portions to soffits or other portions of the roof. Some of the prior art corner portions are relatively costly to produce and many supporting brackets are required to support eavestroughing around a typical roof.

SUMMARY OF THE INVENTION

The invention reduces difficulties and disadvantages of the prior art by providing an eavestrough corner bracket which can be formed from a strip of material by a series of simple bending operations and no other fabrication is required. A bracket for either an outside or an inside corner can be formed from a similar blank of sheet aluminum. The bracket can be simply secured to the building and thus simultaneously supports and joins adjacent mitered edges of eavestroughing at a corner thus reducing the number of separate brackets required.

An eavestrough corner bracket according to the invention is formed by bending a blank characterized by an elongated, bendable sheet strip, the strip having a longitudinal axis, and inner, intermediate, central, and outer portions disposed symmetrically about and axially along the strip. The bracket is adapted to cooperate with adjacent mitred ends of eavestroughing intersecting at a corner. The bracket is characterized by the inner and outer portions being folded about the longitudinal axis to produce respective corner side portions inclined to each other to define side walls of opposed corners. The bracket is also characterized by the intermediate portion being disposed between the inner and central portions and having a plurality of folds, some of which are inclined obliquelyto adjacent portions of the longitudinal axis. This is to permit the corner side portions of the inner portion of the bracket to extend upwardly therefrom, so that the side walls of the opposed corner of the bracket are generally complementary to adjacent intersecting portions of the eavestroughing.

A detailed disclosure following, related to drawings, describes preferred embodiments of the invention which are capable of expression in structure and method other than those particularly described and illustrated.

DETAILED DISCLOSURE

FIG. 1

Figure 1:
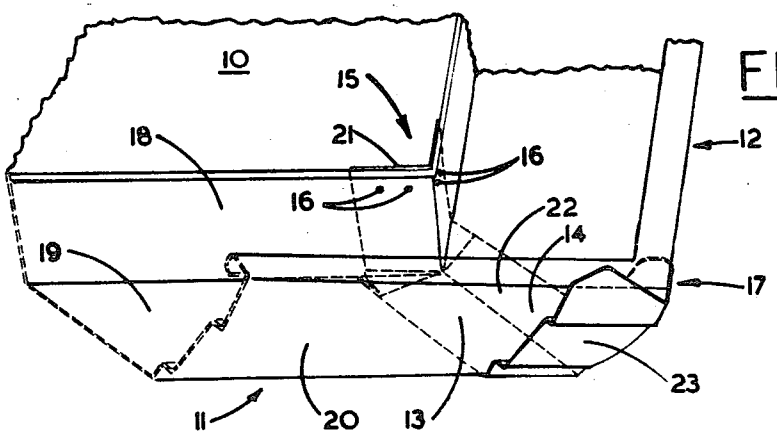
FIG. 1 is a fragmented perspective of eavestroughing intersecting adjacent an outside corner of a building and supported with an outside bracket according to the invention, portions of the building being removed for clarity.

A roof 10 of a building has adjacent lengths of rolled aluminum eavestroughing 11 and 12 having respective mitered ends 13 and 14 intersecting at an outside corner 15. An outside corner bracket 17 according to the invention simultaneously supports the adjacent mitered ends 13 and 14 and seams the junction between the ends which, with rivets and suitable caulking compound, not shown, produces an essentially water tight connection between ends of the eavestroughing 11 and 12. Nails or other fasteners 16 secure the bracket to the building.

The outside corner bracket 17 has an inner portion 21, a central portion 22 and an outer portion 23 which are adapted to cooperate with corresponding inner, central and outer portions 18, 19 and 20 respectively of the eavestroughing 11. The eavestroughing 12 has similar undesignated portions, the portions of the bracket being complementary in shape to adjacent portion of the eavestroughing.

Figure 2:
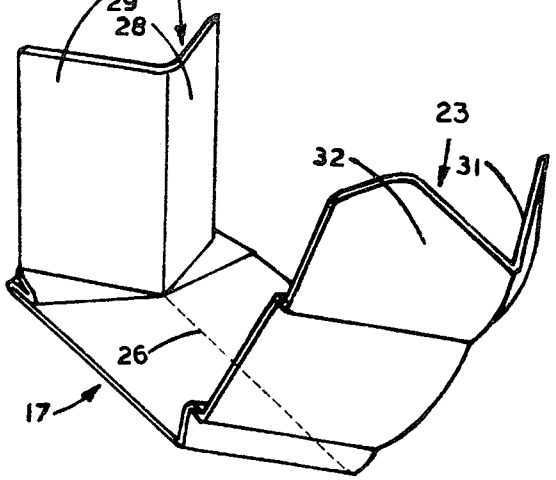
FIG. 2 is a perspective of the outside bracket by itself.
Figure 3:
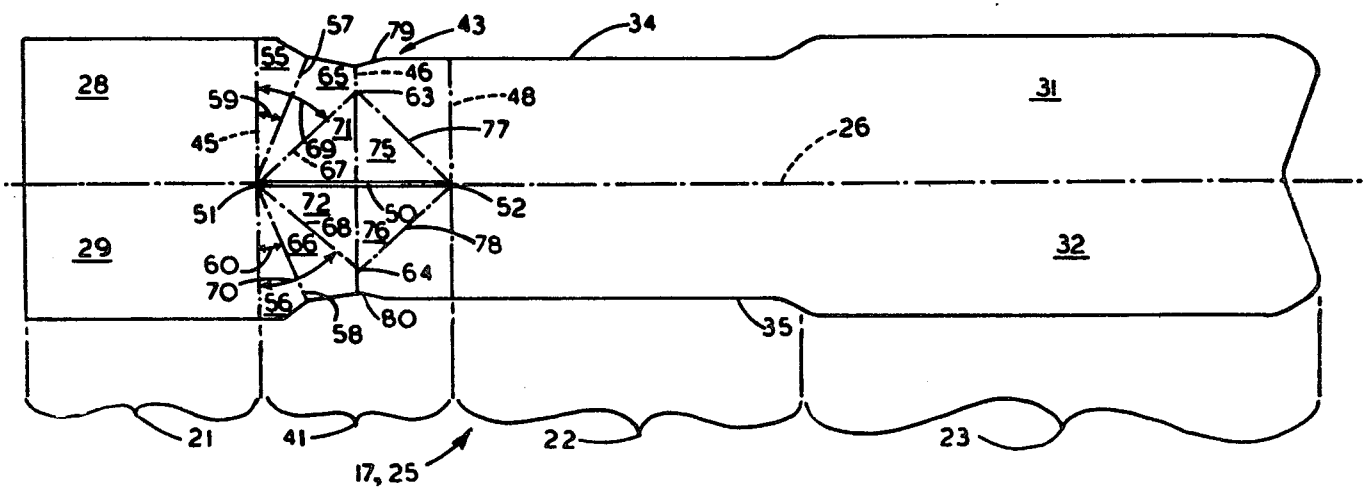
FIG. 3 is a top plan of a blank or strip of material used to form the bracket prior to bending thereof.

FIGS. 2 and 3

As described with reference to FIG. 3, the bracket 17 is formed from an elongated bendable sheet strip or blank 25, such as anodized aluminum, having a central longitudinal axis 26. The inner and outer portions 21 and 23 are folded about the longitudinal axis to produce corner side portions 28 and 29 of the inner portion 21, and corner side portions 31 and 32 of the outer portion 23. The side portions are inclined to each other to define side walls of opposed corners which are generally complementary to the adjacent intersecting inner and outer portions of the eavestroughing which, for normal corners on a house, are inclined at a right angle to each other.

Forming the corner side portions 31 and 32 of the outer portion 23 is a relatively simple bending operation and is not of major importance to the invention. The outer rolled portions of the eavestroughing are commonly convoluted or fluted for ornamental effect and to increase stiffness and it is relatively easy to form this portion of the bracket. Because many of the radii and angles involved are relatively large, one or no more than two stages of forming with conventional forming tools are usually required to accomodate the convolutions of outer portions of the eavestroughing, and also the angles between them at the outer corner.

The present invention relates to the corner side portions 28 and 29 of the inner portion and this aspect is described in more detail with reference to FIG. 3 as follows.

The strip 25 has side edges 34 and 35 and an intermediate portion 41 disposed between the inner and central portions 21 and 22 respectively, the intermediate portion 41 having a plurality of folds 43 to permit the corner side portions 28 and 29 of the inner portion 21 of the bracket to extend upwardly therefrom, as previously described with reference to FIG. 2. The intermediate portion 41 has parallel transverse inner and outer fold axes 45 and 46 and a transverse boundary axis 48, all three axes disposed normally to the longitudinal axis. The outer fold axis is positioned about midway between the inner fold axis 45 and the boundary axis 48 and it can be seen that the inner fold axis and boundary axis define boundaries between the intermediate portion 41 and the inner portion 21, and between the intermediate portion 41 and the central portion 22 respectively. An axially disposed elongated slit 50 extends from an inner end 51 generally adjacent the inner fold axis 45 across the outer fold axis 46 to an outer end 52 generally adjacent the boundary axis. Thus, it can be seen that the slit 50 extends along the axis 26 so as to be midway between the side edges 34 and 35 of the strip and that the outer fold axis 46 approximately bisects the slit. The plurality of folds 43 of the intermediate portion have generally triangular shapes, and are disposed symmetrically about the longitudinal axis and will be described in greater detail as follows. The slit 50 thus extends across the intermediate portion between the inner and central portions.

If the bracket was unfolded and flattened after forming, it would appear generally as in FIG. 3. The plurality of folds 43 includes a pair of generally similar first fold portions 55 and 56 which are defined in part by the inner fold axis 45, and a pair of first oblique fold axes 57 and 58 extending from the inner end of the slit to the opposed side edges 34 and 35 of the bracket. Each first fold axis 57 and 58 is inclined to the inner fold axis at generally equal first angles 59 and 60, respectively, the first angle being about 22 degrees.

The plurality of folds also includes a pair of generally similar second fold portions 65 and 66, the portion 65 being defined in part by the first oblique fold axis 57 and a second oblique fold axis 67, the second oblique fold axis extending from the inner end 51 of the slit to an intersection 63 with the outer fold axis 46 and being inclined to the inner fold axis 45 at a second angle 69. The second fold portion 66 is similarly defined in part by the adjacent first oblique fold axis 58 and an adjacent second oblique fold axis 68. The fold axis 68 extends from the inner end of the slit to an intersection 64 with the outer fold axis 46 and is inclined to the inner fold axis at a second angle 70. The second angles 69 and 70 are generally equal and each first oblique fold axis bisects the adjacent second angle, and thus the second angles are approximately 45 degrees.

The plurality of folds is further characterized by a pair of generally similar third fold portions 71 and 72, the portion 71 being defined by the second oblique fold axis 67, a portion of the outer fold axis 46 and a portion of the slit 50. The third fold portion 72 is generally similar and is defined by the respective oblique fold axis 68, and portions of the outer fold axis 46 and the slit 50. The plurality of folds also includes generally similar fourth fold portions 75 and 76, each fourth fold portion being generally similar geometrically to the adjacent third fold portion to form two pairs of similar triangles. The fourth fold portion 75 is defined in part by a third oblique fold axis 77 extending from the outer end 52 of the slit to the intersection 63 of the second fold axis with the outer fold axis 46. The remaining two sides of the fold portion 75 are defined by the portion of the outer fold axis 46 which is common to the adjacent third fold portion 71 and by a portion of the slit 50. The fourth fold portion 76 is similarly defined by a third oblique fold axis 78 extending from the end 52 of the slit to the intersection 64 of the second oblique fold axis 68 with the inner fold axis 46, and has two remaining sides defined by the portion of the outer fold axis 46 common with the fold portion 72 and a portion of the slit 50.

The above plurality of folds and fold axes are described generally because the folds are not formed whilst the blank is flat, but are produced in a particular sequence as the strip is folded, as will be described with reference to FIGS. 4 and 5.

The blank is shown with edge portions 79 and 80 of the side edges 34 and 35 adjacent fold axis 46 of the intermediate portions recessed inwardly relative to adjacent side edges. This is to reduce creases in the sheet material that otherwise would tend to form. Also, the side edges of the central portion are recessed relative to the inner and outer portions of the strip. This is to produce a bracket which, when folded according to the invention, has side edges of the inner, central and outer portions that are generally coplanar. The folding of the inner and outer portions necessarily reduces overall width of the folded portions and thus additional width is required to produce a similar overall width to the non-folded central portion so as to maintain coplanar side edges.

OPERATION

Figure 4:
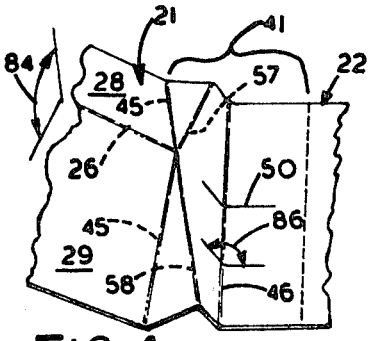
FIG. 4 is a fragmented perspective of a portion of the strip of material at the first stage of bending.
Figure 5:
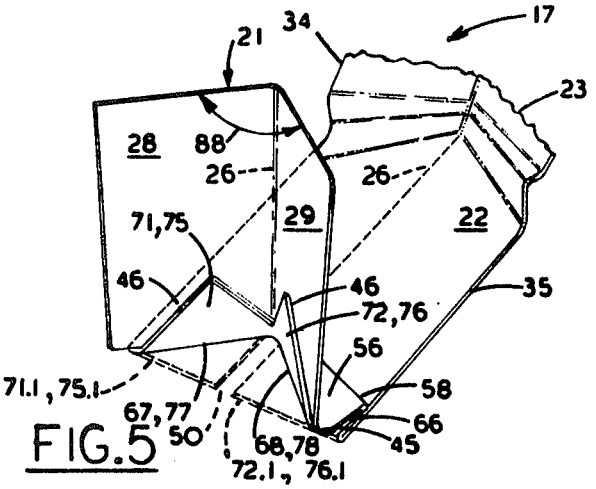
FIG. 5 is a fragmented perspective of a portion of the bracket showing second and third stages of bending.

FIGS. 4 and 5

Figure 6:
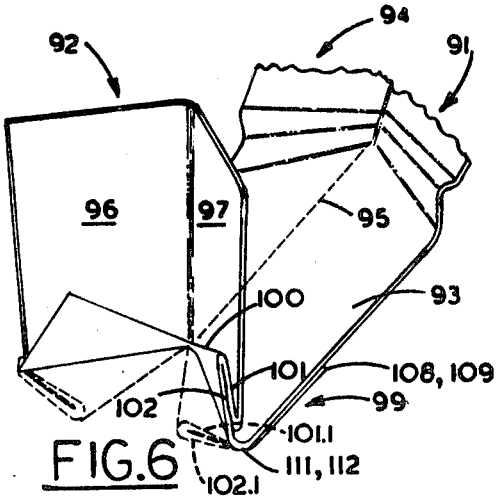
FIG. 6 is a fragmented perspective of an alternative outside corner bracket made by alternative bending steps, FIG. 7 which is shown on Sheet 1 of the drawings, is a fragmented perspective of a portion of an alternative inside corner bracket made from a similar blank by alternative steps.

The manner of folding of the blank to produce the above folds is described for one preferred embodiment, but other outside corner brackets, using similar folds can be devised, one alternative outside corner bracket being described with reference to FIG. 6. An alternative inside corner bracket is described briefly with reference to FIGS. 7 and 8.

The method of forming and folding of this bracket by first, second and third dies, which are not shown, is considered a major aspect of this invention and this is now described in detail. At an early stage, the axially disposed, elongated slit 50 is produced in the blank of the bracket so as to extend generally from inner and outer ends thereof adjacent the inner fold axis and the boundary axis respectively. This slit can be produced when the blank of the strip is initially stamped or cut from the parent material, and even if the slit does not extend completely between the axes 45 and 48, it will likely extend by tearing towards these axes during the forming processes.

FIG. 4 shows the intermediate portion 41 of the bracket, with adjacent inner and central portions 21 and 22 after being formed in the first die. It can be seen that the inner portion 21 of the bracket is folded longitudinally about the longitudinal axis 26, and the intermediate portion is folded generally transversely about the axes 57, 58 and 46. This is accomplished by folding the blank also about the axis 45, which axis has two halves folded in different directions. The inner and intermediate portions of the bracket are folded in an opposite direction about the inner fold axis 45 and the first oblique fold axes 57 and 58. Thus the slit 50 extends across adjacent fold portions of the intermediate portion which are inclined to each other at an angle 86. At this stage, the corner portions 28 and 29 are inclined to each other at an angle 84 which is about 130 degrees, and the angle 86 between adjacent portions of the intermediate portion is about 110 degrees. The outer portion of the bracket, not shown, can be partially or completely folded at this time so as to be complementary to the outer portions of the eavestroughing and because this requires no special procedure, this aspect of the blank folding is not described.

Referring to FIG. 5, a portion of the bracket is shown after being formed by the second die, after which the corner portions 28 and 29 are now inclined at an angle 88. The angle 88 is about 90 degrees and thus is a reentrant angle complementary to a corner formed by intersecting portions of eavestroughing, as shown in FIG. 2. The intermediate portion 41 has now been folded so that the adjacent first and second fold portions 56 and 66 are folded together so as to lie adjacent each other and are almost coplanar with each other and also with the central portion 22. Similarly, the first and second fold portions 55 and 65, not shown, on the opposite side of the axis 26 are similarly folded together so as to be almost coplanar with each other and adjacent the central portion 22 but these cannot be seen in this view. It can be seen that the first and second fold portions 56 and 66 lie parallel and adjacent to a remaining portion of the intermediate portion 41 of the bracket, with the second fold portion 66 being sandwiched between the adjacent first fold portion 56 and the remaining portion of the intermediate portion. After folding by the second die, the third and fourth fold portions 71 and 75 on one side of the slit 50 are folded flat and shown in broken outline at 71.1 and 75.1 in an intermediate position in which they are generally parallel and almost coplanar with each other and with the central portion 22 and are located on a side of the folded inner portion 21 remote from the central portion 22. Similarly, on the same side of the folded inner portion, the third and fourth fold portions 72 and 76 are shown in broken outline in intermediate positions 72.1 and 76.1 on the opposite side of the axis 26 and are folded flat against each other so as to be almost coplanar with each other and with the central portion 22. It can be seen that adjacent edges of the slit of the third and fourth fold portions lie adjacent each other. Note that commonly these third and fourth fold portions are not necessarily completely flattened together in their intermediate positions, but may in fact be warped or wrinkled.

Still referring to FIG. 5, after forming by the third die, the folded together pairs of adjacent third and fourth fold portions 71 and 75, and 72 and 76 are folded upwards concurrently about the respective second and third oblique fold axes 67 and 77, and 68 and 78 respectively through about 90 degrees from the intermediate positions shown in broken outline to assume the final positions 71, 75, 72 and 76 shown in full outline in which the fold portions are adjacent to and generally coplanar with the corner portions 28 and 29 respectively.

When folded about the second and third oblique fold axes, the third and fourth fold portions 72 and 76 lie parallel and adjacent to the inclined corner side portion 29 of the inner portion of the bracket, with the third portion 72 being sandwiched between the adjacent fourth fold portion 76 and the adjacent corner side portion 29. The opposite side of the bracket is similar. It can be seen that the folded together pairs of third and fourth fold portions stiffen the corner portions 28 and 29 adjacent the inner corner, and the folded together pairs of first and second fold portions stiffen the central portion adjacent the inner corner.

Thus, in summary, one method of producing the bracket is characterized by bending the intermediate portion 41 in one direction about the inner and outer fold axes 45 and 46, and in an opposite direction about the first oblique fold axes 57 and 58 so as to produce a generally Z-shaped shape when completed by the first die, see FIG. 4. The inner portion 21 thus becomes folded about the longitudinal axis 26 in the same direction as the fold about the first oblique axes 57 and 58 to produce the two inclined corner side portions 28 and 29. The intermediate portion 41 is then completely folded about the inner and outer fold axes 45 and 46 and the first oblique fold axes 57 and 58 so that the first and second fold portions 56 and 66 of FIG. 5 lie adjacent each other. In this condition the second fold portion 66 is sandwiched between adjacent first fold portion 56 and the intermediate portion 41, and the two corner side portions 28 and 29 are inclined to each other at the inner corner angle 88. In the intermediate stage, as shown partially in broken line in FIG. 6, the third and fourth fold portions lie adjacent and parallel to each other so that adjacent edges of the slit lie folded in half and adjacent each other and between the inclined corner side portions 28 and 29. In the final stage shown in full outline, the third and fourth fold portions 71 and 75, and 72 and 76 on each side are folded about respective second and third fold axes 67 and 77, 68 and 78 respectively so that the third and fourth fold portions lie parallel and adjacent to the inclined portions of the inner portion of the bracket. In this position as shown, each third fold portion is sandwiched between the adjacent fourth fold portion and the adjacent corner side portion.

ALTERNATIVES AND EQUIVALENTS

FIG. 5 shows a preferred method of folding in which the second fold portions are sandwiched between the first fold portion and the intermediate portion, and the third fold portions are sandwiched between the fourth fold portions and the corner side portions. Other combinations of folding are possible, for example, the second fold portion could be sandwiched between the first fold portion and the intermediate portion below the intermediate portion, and the third fold portion could be sandwiched between the fourth fold portion and the corner side portion on an opposite side of the corner side portion. This latter combination is not shown, and may be more costly to produce but because it is merely an interchanging of fold portions with the corner side portions and intermediate portions it is considered equivalent because it can be made from a blank having similar fold axes. Further alternative methods of folding the blank are described below.

FIG. 6

An alternative outside corner bracket 91 has similar inner, central and outer portions 92, 93 and 94 respectively and a longitudinal axis 95, the inner portion being folded to provide two inclined corner side portions 96 and 97, as previously described. The bracket 91 has an intermediate portion 99 having similar fold axes and folds in the same positions as those shown in the blank 25 of FIG. 3, but some of the directions of folding are opposite to produce a different but equivalent final structure. The bracket is folded symmetrically about the axis 95 and thus one half only is disclosed. The portion 99 is folded about a first oblique fold axis 100 to produce first and second fold portions 101 and 102, which when the bracket is completely folded the first and second fold portions lie parallel and adjacent to the inclined corner side portion 97. The first fold portion 101 is thus sandwiched between the adjacent second fold portion 102 and the adjacent corner side portion 97. The bracket has third and fourth fold portions 108 and 109 which are folded about second and third oblique fold axes 111 and 112 so as to lie adjacent and parallel to a remaining portion of the intermediate portion of the bracket. The fourth fold portion is now sandwiched between the adjacent third fold portion and the remaining portion of the intermediate portion. The first and second fold portions are shown in broken lines at intermediate positions 101.1 and 102.1 prior to the final folding.

In this alternative, it can be seen that portions of the first and second fold portions of the first embodiment have been interchanged with the third and fourth fold portions and vice versa on each side of the longitudinal axis resulting in a generally similar arrangement. Similarly to the previous alternative, by using similar fold portions, it is also possible to position the first and second fold portions on opposite sides of the corner portions, and the third and fourth fold portions on opposite sides of the central portion. Other means of folding the intermediate portion to produce two inclined corner portions can be devised.

Figure 7:
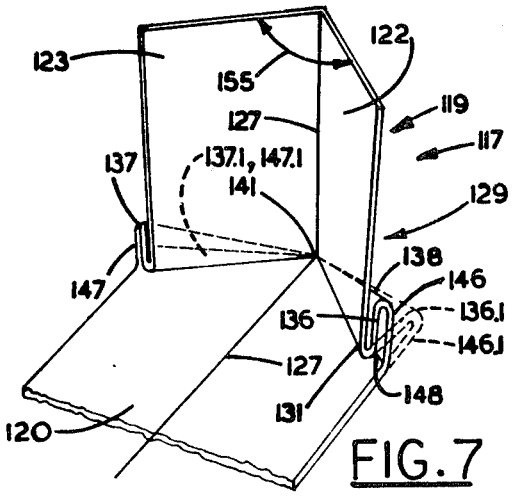
Figure 8:
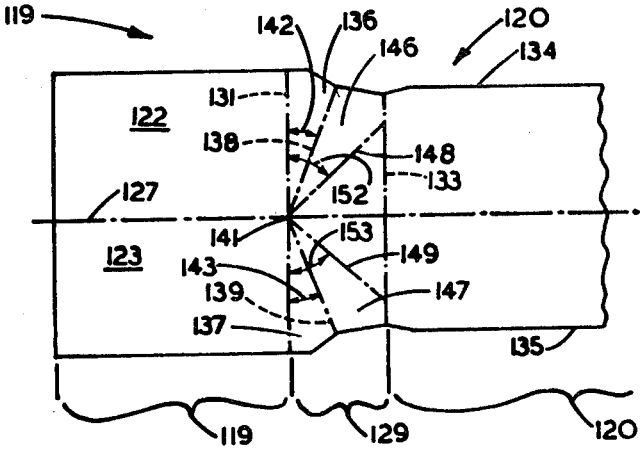
FIG. 8 is a fragmented top plan of a portion of a blank or strip of material used to form the inside corner bracket prior to bending, and is also shown on Sheet 1 of the drawings.

FIGS. 7 and 8

A further alternative bracket is an inside corner bracket 117, which is for use at an inside corner of a roof where adjacent eavestroughs, not shown, are inclined at 90 degrees to each other. The bracket 117 has many similarities to the previously described bracket, in particular, the bracket has inner and central portions 119 and 120 adapted to cooperate with inner and central portions respectively of eavestroughing adjacent the corner, not shown. The bracket also has an outer portion, not shown, which is similarly formed to be complementary to the fluted intersecting outer portions of the eavestroughing, and this outer portion is easily formed using prior art methods similarly to the outer portions of the previously described brackets and is not described. The invention relates to forming the bracket to produce inclined corner side portions 122 and 123 of the inner portion 119 extending adjacent the central portion.

The bracket 117 is formed from an elongated, bendable sheet strip or blank 125 which is very similar to the strip 25 of FIG. 1 with differences as will be particularized. The blank has a longitudinal axis 127 and an intermediate portion 129 disposed between the central portion 120 and the inner portion 119. Referring to FIG. 8, the intermediate portion 129 is characterized by a transverse inner fold axis 131 and a parallel boundary axis 133, the axes defining boundaries between the inner portion and the intermediate portion and between the intermediate portion and the central portion respectively. The intermediate portion 129 includes a plurality of folds which resemble the folds of the brackets 17 and 91 but are less complicated because the folding of the inside corner bracket 117 is simpler than that of the outside corner brackets 17 and 91. The slit 52 and the third and fourth fold portions of the previous embodiments are eliminated and thus there is no transverse outer fold axis extending centrally of the intermediate portion as shown in FIG. 3.

The bracket has opposed side edges 134 and 135 which extend in a generally parallel manner along long edges of the blank, with irregularities as shown to accommodate differences in widths of portions of the bracket when folded, in a manner generally similar to the previously described embodiments. The intermediate portion 129 has a pair of generally similar first fold portions 136 and 137 defined in part by the inner fold axis 131 and a pair of first oblique fold axes 138 and 139 respectively. The first oblique fold axes extend from an intersection 141 of the longitudinal axis 127 and the inner fold axis 131 to the opposed side edges 134 and 135 respectively of the bracket. The first oblique fold axes 138 and 139 are inclined at equal first angles 142 and 143 to the inner fold axis as shown. The intermediate portion 129 above includes a pair of generally similar second fold portions 146 and 147 as shown. The portion 146 is defined in part by the adjacent first oblique fold axis 138 and an adjacent second oblique fold axis 148. The second oblique fold axis is one of a pair of second fold axes extending from the intersection 141, the further second oblique fold axis 149 defining together, with the first oblique fold axis 139, the second fold portion 147. The second oblique fold axes 148 and 149 are inclined to the inner fold axis 131 at generally equal second angles 152 and 153 respectively. It can be seen that each first oblique fold axis bisects the adjacent second angle, the second angle being about 45 degrees.

When comparing the arrangement of fold axes on the strip 25 of FIG. 3 with the fold axes on the strip 125 of FIG. 7, it can be seen that the respective inner fold axes 45 and 131 are similar and the first and second fold portions 55, 56, 65 and 66 of FIG. 3 are generally similarly to the first and second fold portions 136, 137, 146 and 147 of FIG. 8. One difference relates to the designation of the boundary of the intermediate portion which, in FIG. 3, is the transverse boundary axis 48 whereas in FIG. 7, the corresponding boundary is the transverse boundary axis 133. As previously stated there is no outer fold axis in the FIG. 8 embodiment corresponding to the outer fold axis 46 in FIG. 3, although the axis 133 of FIG. 8 is coincident with the portion of the axis 46 of FIG. 3. Thus a portion of the intermediate portion between the axes 46 and 48 of FIG. 3 is eliminated in FIG. 8 thus resulting in a shorter blank.

Folding of the bracket 117 is simpler than folding of the bracket 17, and again alternatives are envisaged. In FIG. 7, the intermediate portion of the bracket is folded in opposite directions about the inner fold axis 131 and the first oblique fold axes 138 and 139 so that the first and second fold portions 136 and 146, and 137 and 147 lie adjacent each other in intermediate portions 136.1, 137.1, 146.1 and 147.1 as shown in broken outline in FIG. 7. The first and second fold portions are shown in broken outline lying parallel and adjacent to each other and generally coplanar with the intermediate portion prior to final folding. This bending inclines the opposed corner side portions 122 and 123 of the inner portion 119 towards each other to define a re-entrant angle 155 at the corner adjacent the inner portion of the bracket. A final folded configuration of the fold portion is as shown in full outline at 136, 137, 146 and 147 respectively, in which the first fold portions 136 and 137 lie parallel to, and are sandwiched between the adjacent corner side portions 122 and 123 and the remaining second fold portion 146 and 147 respectively. In this position, the first and second fold portions are positioned on the outside of the corner side portions and one alternative would be to fit the folded first and second portions on the inside of the folded corner side portion, which alternative is not shown.

The illustrated arrangement is preferred as the central portion 120 and corner side portions 122 and 123 are held together in a mechanically more rigid arrangement than when the folded first and second fold portions are interchanged in the alternative. In either configuration, the first and second fold portions lie parallel and adjacent to the adjacent inclined corner portion so that one fold portion is sandwiched between the adjacent corner side portion and the remaining fold portion.

Thus, in summary, it can be seen that the method of folding the bracket for use at an outside corner is characterized by bending the intermediate portion 129 in one direction about the inner fold axis 131 and in an opposite direction about the first oblique fold axes 138 and 139. The inner portion is then folded about the longitudinal axis 127 in the same direction as the fold about the first oblique axes to produce the two inclined corner side portions 122 and 123. The intermediate portion 129 is then completely folded about the inner fold axis and the first oblique fold axes to fold together the adjacent first and second fold portions, which portions are defined in part by the respective inner fold axes and the first oblique fold axes, and the respective first and second oblique fold axes respectively. In this intermediate folded position, the first and second fold portions are folded to lie adjacent each other. In the final configuration, the fold portions are folded together so that one of the fold portions is sandwiched between the adjacent corner side portion and the remaining fold portion with the two corner side portions inclined to each other at an inner corner angle.

I claim:

1. An eavestrough corner bracket, which is formed by bending a blank characterized by an elongated, bendable sheet strip, the strip having a longitudinal axis, and inner, intermediate, central, and outer portions disposed symmetrically about and axially along the strip, the bracket being adapted to cooperate with adjacent mitred ends of eavestroughing intersecting at a corner, the bracket being characterized by:

(a) the inner and outer portions being folded about the longitudinal axis to produce respective corner side portions inclined to each other to define side walls of opposed corners, (b) the intermediate portion being disposed between the inner and central portions, the intermediate portion having a plurality of folds, some of which are inclined obliquely to adjacent portions of the longitudinal axis to permit the corner side portions of the inner portion of the bracket to extend upwardly therefrom, so that the side walls of the opposed corners of the bracket are generally complementary to adjacent intersecting portions of the eavestroughing.

2. An eavestrough corner bracket as claimed in claim 1 in which the bracket is for use at an outside corner, and the intermediate portion is further characterized by:

(a) parallel transverse inner and outer fold axes and a transverse boundary axis, all of which are disposed normally to a respective adjacent portion of the longitudinal axis, the outer fold axis being positioned along the longitudinal axis about mid-way between the inner fold and boundary axes, the inner fold axis and boundary axis defining boundaries between the intermediate portion and the inner portion, and between the intermediate portion and central portion respectively, (b) an axially disposed elongated slit extending along the longitudinal axis from an inner end of the slit generally adjacent the inner fold axis across the outer fold axis to an outer end of the slit generally adjacent the boundary axis, so that the outer fold axis approximately bisects the slit.

3. An eavestrough corner bracket as claimed in claim 2 in which the intermediate portion is further characterized by:

(a) a pair of generally similar first fold portions defined in part by the inner fold axis and a pair of first oblique fold axes extending from the inner end of the slit to opposed side edges of the bracket, each first oblique fold axis being inclined to an adjacent portion of the inner fold axis at generally equal first angles, (b) a pair of generally similar second fold portions, each second fold portion being defined in part by an adjacent first oblique fold axis and an adjacent second oblique fold axis of a pair of second oblique fold axes extending from the inner end of the slit and inclined to an adjacent portion of the inner fold axis at generally equal second angles, each first oblique fold axis bisecting the adjacent second angle, so that when the intermediate portion of the bracket is folded in opposite directions about the inner fold axis and the first oblique fold axes, the first and second fold portions lie adjacent each other thus inclining the opposed side corner portions of the inner portion towards each other to define the corner adjacent the inner portion of the bracket.

4. An eavestrough corner bracket as claimed in claim 3 in which the plurality of folds is further characterized by:

(a) a pair of generally similar third fold portions each being defined by a respective second oblique fold axis, the outer fold axis and the slit, (b) a pair of generally similar fourth fold portions, each fourth fold portion being also generally similar to the third fold portions and being defined by a respective third oblique fold axis extending from the outer end of the slit to an intersection of the second oblique axis with the inner fold axis, and by the outer fold axis and the slit, so that when the intermediate portion is folded, the opposite corner side portions of the inner portion are inclined to each other to form a re-entrant angle for an outside corner, the third and fourth fold portions lie adjacent and parallel to each other and the slit is folded so that adjacent edges of the slit of the third and fourth fold portions lie adjacent each other.

5. An eavestrough corner bracket as claimed in claim 4 in which:

(a) the first and second fold portions lie parallel and adjacent to a remaining portion of the intermediate portion of the bracket with the second fold portions being sandwiched between the adjacent first fold portions and the remaining portion of the intermediate portion, (b) the third and fourth fold portions are folded about the second and third oblique fold axes so as to lie parallel and adjacent to the inclined corner side portions of the inner portion of the bracket with the third fold portions being sandwiched between the adjacent fourth fold portions and the adjacent corner side portions.

6. An eavestrough corner bracket as claimed in claim 4 in which:

(a) the first and second fold portions lie parallel and adjacent to the inclined corner side portions of the inner portion of the bracket with the first fold portions being sandwiched between the adjacent second fold portions and the adjacent corner side portions, (b) the third and fourth fold portions are folded about the second and third oblique axes so as to lie adjacent and parallel to a remaining portion of the intermediate portion of the bracket, the fourth fold portions being sandwiched between the adjacent third fold portions and the remaining portion of the intermediate portion.

7. An eavestrough corner bracket as claimed in claim 1 in which the bracket is for use at an inside corner, and the intermediate portion is further characterized by:

(a) a transverse inner fold axis and a parallel boundary axis defining bondaries between the inner portion and the intermediate portion, and between the intermediate portion and the central portion respectively, (b) a pair of generally similar first fold portions defined in part by the inner fold axis and a pair of first oblique fold axes extending from an intersection of the longitudinal and inner fold axes to opposed side edges of the bracket, each first oblique fold axis being inclined to an adjacent portion of the inner fold axis at generally equal first angles, (c) a pair of generally similar second fold portions, each second fold portion being defined in part by an adjacent first oblique fold axis and an adjacent second oblique fold axis, the second oblique fold axis being one of a pair of second oblique fold axes extending from the intersection of the longitudinal and inner fold axes and inclined to an adjacent portion of the inner fold axis at generally equal second angles, each first oblique fold axis bisecting the adjacent second angle, so that when the intermediate portion of the bracket is folded in opposite directions about the inner fold axis and the first oblique fold axis, the first and second fold portions lie adjacent each other thus inclining the opposed side corner portions of the inner portion towards each other to form a re-entrant angle for an inside corner adjacent the inner portion of the bracket.

8. An eavestrough corner bracket as claimed in claim 7 in which:

(a) the first and second fold portions lie parallel and adjacent to the adjacent inclined corner portion so that one fold portion is sandwiched between the adjacent corner portion and the remaining fold portion.

* * * * *